US010240225B2

(12) United States Patent
Komuro et al.

(10) Patent No.: US 10,240,225 B2
(45) Date of Patent: Mar. 26, 2019

(54) STEEL MATERIAL, MATERIAL PROCESSING METHOD, AND MATERIAL PROCESSING APPARATUS

(71) Applicant: HITACHI, LTD., Tokyo (JP)

(72) Inventors: Matahiro Komuro, Tokyo (JP); Masafumi Noujima, Tokyo (JP); Naoya Okizaki, Tokyo (JP)

(73) Assignee: HITACHI, LTD., Tokyo (JP)

( * ) Notice: Subject to any disclaimer, the term of this patent is extended or adjusted under 35 U.S.C. 154(b) by 757 days.

(21) Appl. No.: 14/856,703

(22) Filed: Sep. 17, 2015

(65) Prior Publication Data

US 2016/0083821 A1 Mar. 24, 2016

(30) Foreign Application Priority Data

Sep. 19, 2014 (JP) ..... 2014-190662

(51) Int. Cl.

| | |
|---|---|
| ***C21D 1/34*** | (2006.01) |
| ***C22C 38/44*** | (2006.01) |
| ***C21D 1/40*** | (2006.01) |
| ***C21D 1/04*** | (2006.01) |
| ***C21D 6/00*** | (2006.01) |
| ***C22C 38/42*** | (2006.01) |
| ***C22C 38/04*** | (2006.01) |
| ***C22C 38/22*** | (2006.01) |
| ***C22C 38/02*** | (2006.01) |
| ***C22C 38/24*** | (2006.01) |
| ***C22C 38/10*** | (2006.01) |
| ***C22C 38/00*** | (2006.01) |
| ***C22C 38/30*** | (2006.01) |
| ***C22C 38/52*** | (2006.01) |
| ***C23C 8/22*** | (2006.01) |
| ***C23C 8/26*** | (2006.01) |
| ***H01F 1/16*** | (2006.01) |

(52) U.S. Cl.

CPC ..... *C22C 38/44* (2013.01); *C21D 1/04* (2013.01); *C21D 1/34* (2013.01); *C21D 1/40* (2013.01); *C21D 6/002* (2013.01); *C21D 6/004* (2013.01); *C21D 6/005* (2013.01); *C21D 6/007* (2013.01); *C21D 6/008* (2013.01); *C22C 38/001* (2013.01); *C22C 38/02* (2013.01); *C22C 38/04* (2013.01); *C22C 38/10* (2013.01); *C22C 38/22* (2013.01); *C22C 38/24* (2013.01); *C22C 38/30* (2013.01); *C22C 38/42* (2013.01); *C22C 38/52* (2013.01); *C23C 8/22* (2013.01); *C23C 8/26* (2013.01); *H01F 1/16* (2013.01); *C21D 2211/005* (2013.01)

(58) Field of Classification Search

CPC ..... C21D 1/06

See application file for complete search history.

(56) References Cited

U.S. PATENT DOCUMENTS

| | | | |
|---|---|---|---|
| 2001/0017172 | A1 | 8/2001 | Maruta et al. |
| 2007/0068605 | A1 | 3/2007 | Statnikov |

FOREIGN PATENT DOCUMENTS

| | | | | | |
|---|---|---|---|---|---|
| JP | 56116830 | A | * | 9/1981 | ..... C21D 9/62 |
| JP | 2000-328143 | A | | 11/2000 | |
| JP | 2001-234240 | A | | 8/2001 | |
| JP | 2009-510256 | A | | 3/2009 | |

OTHER PUBLICATIONS

English machine translation of JP56-116830A of Yamazaki (Year: 1981).*

* cited by examiner

*Primary Examiner* — Jessee R Roe
*Assistant Examiner* — Jophy S. Koshy
(74) *Attorney, Agent, or Firm* — Volpe and Koenig, P.C.

(57) ABSTRACT

Disclosed herein is a technique to reduce the residual stress of a steel material while improving the mechanical property and the corrosion resistance of the material. A steel material is provided that includes a plurality of ferrite crystal grains, and a laminar iron-rich phase formed at unidirectionally occurring grain boundaries of all grain boundaries of the ferrite crystal grains. A material processing method is provided that includes: heating a steel material that contains a plurality of ferrite crystal grains; applying a magnetic field to a heated portion while heating the steel material; applying an electric field to the heated portion in a direction that crosses the direction of the applied magnetic field while heating the steel material; and measuring a displacement occurring in the steel material under the magnetic field and the electric field.

1 Claim, 3 Drawing Sheets

STEEL MATERIAL, MATERIAL PROCESSING METHOD, AND MATERIAL PROCESSING APPARATUS

BACKGROUND OF THE INVENTION

Field of the Invention

The present invention relates to a steel material, a material processing method, and a material processing apparatus.

Description of the Related Art

A magnetic field application method as a structure control technique to improve the mechanical property, corrosion resistance, and functionality of iron-based metallic materials is known. JP-A-2001-234240 and JP-A-2000-328143 describe controlling a structure through magnetic field application in a temperature region no greater than the magnetic transformation point of a steel material.

JP-T-2009-510256 discloses a technique to suppress degradation through application of ultrasonic impact from a structural material surface.

In the techniques of the related art, structures are controlled by allowing the diffusion to simultaneously proceed with magnetic field application, and the techniques require heating and maintaining a temperature range in which crystal grain growth can occur. The ultrasonic impaction is effective at reducing the residual stress on a material surface, but involves difficulties in structure control.

Desired for controlling the structure of a steel material is a technique that can be implemented under as low a temperature as possible. Magnetic field application predominantly acts on the ferromagnetic phase, and enables crystal grain growth in the ferromagnetic phase along the magnetic field direction. Ultrasonic application is effective as a technique that induces dislocation or defect migration.

Ferromagnetic crystal grain growth increases the crystal grain size, and lowers mechanical property and corrosion resistance. There accordingly is a need for a technique that enables reducing residual stress while improving mechanical property and the corrosion resistance.

SUMMARY OF THE INVENTION

The invention provides solutions to the foregoing problems with, for example, the configurations recited in the claims set forth below.

The invention enables reducing residual stress while improving mechanical property and corrosion resistance.

DESCRIPTION OF THE PREFERRED EMBODIMENTS

The following means are effective to minimize crystal grain growth, and to improve mechanical property and corrosion resistance, and increase lifetime.

1) To apply a magnetic field, an electric field, and a strain field substantially simultaneously to a material in addition to heat energy, and control each of these fields.

2) To use local heating, application of a local magnetic field, a local electric field, and a local strain field.

3) To apply a stress field by the Lorentz force with an AC current passed across a magnetic field with electrodes, using a heating heat source, and a coil magnetic field or a magnet magnetic field.

These techniques are used to apply a magnetic field to the heated material, and the frequency of the AC current passed through the target material is controlled to generate a high-frequency elastic displacement. Magnetic field energy and stress (vibration) are two of the energies applied other than the heat energy.

Heat may be applied with an energization heater or an infrared heater, or a welding laser, in a temperature range of 20° C. to 600° C. The magnetic field may be a static magnetic field, a gradient magnetic field, or an alternating magnetic field, and ranges from 0.01 to 10 T for the static magnetic field. The current is desirably a radiofrequency current, preferably with the selected frequency that maximizes the displacement.

The external fields applied to a structural material act as follows. Passing AC current in a magnetic field generates the Lorentz force, and the Lorentz force vibration generates a displacement or a strain field. The magnetic field promotes rearrangement of atoms in a manner that increases magnetization or magnetic susceptibility. At the same time, the current contributes to migration of charged elements. The generated strain field causes migration of defects or dislocations, and promotes migration of the elements trapped in defects or dislocations.

The synergy by the external fields enables structure control, as follows.

1) Promotes diffusion of solute elements.

2) Promotes diffusion of grain boundary concentrated elements.

3) Increases magnetization or magnetic susceptibility only in the vicinity of the grain boundary.

4) Eliminates grain boundary precipitation sites.

5) Relax stress at grain boundaries.

Embodiments of the invention are described below in detail with reference to the accompanying drawings. It should be noted that the invention is not limited to the embodiments described herein, and the embodiments may be appropriately combined or modified within the gist of the invention.

First Embodiment

Figure 1:
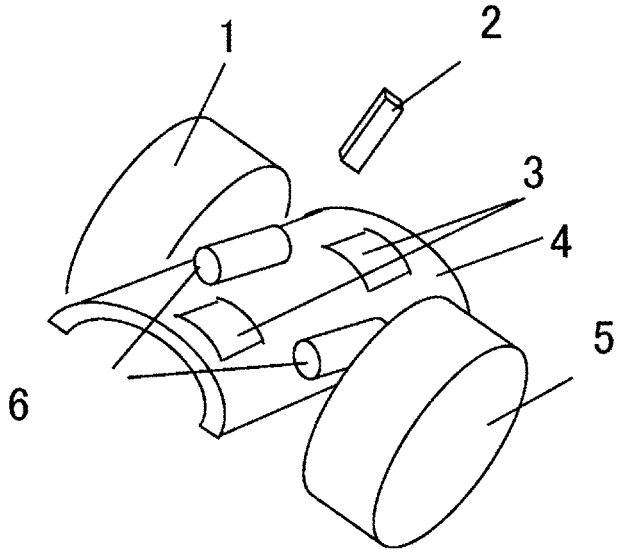
FIG. 1 is a diagram representing a configuration for an electromagnetic elastic wave process.

FIG. 1 is a diagram representing a configuration of a steel material processing apparatus. The biphasic stainless steel material used in the present embodiment has the composition Fe-25.28 Cr-7.01 Ni-3.90 Mo-0.99 Mn-0.43 Cu-0.13 W-0.024 C-0.27 N (wt %). The present embodiment describes processing of a pipe formed by using the biphasic stainless steel material. The apparatus includes an electromagnet 1, a displacement gauge 2, electrodes 3, a pipe 4, an electromagnet 5, and heaters 6.

The electromagnets 1 and 5 are disposed on the both sides of the rolling direction of the pipe 4. The pipe 4 is rolled around its circumference. The two electrodes 3 are disposed on the surface of the pipe 4. The pipe 4 is shown as being subjected to an electric field and a magnetic field that are applied orthogonal to each other. The heaters 6 are disposed in the vicinity of the pipe 4, and heat the pipe surface subjected to an electric field and a magnetic field. Applying an electric field and a magnetic field to the pipe 4 generates the Lorentz force (strain field). The pipe 4 strains under the Lorentz force, and the strain amount (displacement) is measured with the displacement gauge 2. The location of the displacement gauge is not particularly limited.

The electromagnets 1 and 5 apply a 1.0 T magnetic field in the rolling direction of the pipe 4. The surface electrodes pass a 0.1 A/mm$^2$ current at 20 kHz frequency in a direction orthogonal to the direction of the applied magnetic field. The magnetic field is applied parallel to the rolling surface (rolling direction), and the material under the magnetic field is heated to 450° C., maintained at this temperature for 0.5 hours, and allowed to cool to 400° C. over the course of 1 hour. The displacement under the applied current is 10 nm to 5000 nm along a direction at a right angle to the current passing surface. The direction of the applied electric field and the direction of the applied magnetic field are not necessarily required to be orthogonal to each other, provided that the Lorentz force is generated. It is, however, preferable to apply the electric field and the magnetic field orthogonal to each other as in the present embodiment because it maximizes the generated Lorentz force, enables the applied electric field and magnetic field to be reduced in magnitude for improved efficiency.

The applied magnetic field causes the ferromagnetic elements to arrange themselves parallel to the magnetic field, and diffuses nitrogen, carbon, and the impurity element oxygen along the grain boundary. The process by which the material is simultaneously acted upon by the electric field, the magnetic field, and the elastic wave during the heating of the material (electromagnetic elastic wave process) suppresses the precipitation of a brittle phase such as the σ phase, and reduces an impact value drop at welding.

The following describes the parameters of the process conditions of the present embodiment. The magnetic field acts to increase the magnetization of the ferromagnetic phase, and causes rearrangement of ferromagnetic elements in the vicinity of the grain boundary, which is susceptible to the effect of the stress field. This causes growth of an iron-rich phase abundant in iron in the vicinity of the grain boundary, substantially parallel to the direction of the applied magnetic field. The iron-rich phase contains iron in a concentration range of 60 to 98 weight %. Because of the high iron content, the iron-rich phase has magnetization 1 to 30% greater than the average magnetization, and exists as a layer in a 0.1 to 500 nm domain from the grain boundary. The Curie point of the layer also increases. Because the magnetic field can exert the maximum effect when applied in a direction of a small diamagnetic field, the magnetic field is applied substantially parallel to the rolling direction in the present material in which the ferromagnetic phase extends along the rolling direction.

The stress field makes it easier to diffuse nitrogen, oxygen, and carbon to the grain boundary, and make an oxide, a carbide, or a nitride grow in parts of the grain boundary. Because the iron-rich phase is compositionally distant from the brittle σ phase, the σ phase growth is suppressed more than when the iron-rich phase is not formed. The σ phase precipitation sites also decrease, and formation of the brittle phase is suppressed because of the reduced stress at the ferromagnetic phase/non-magnetic phase interface. The effect of the stress field can be seen under a magnetic field of 0.1 to 10 T, a current density of 0.01 to 1 A/mm$^2$, and a frequency of 1 to 10 GHz. The Doppler laser displacement gauge can then detect a 1 nm to 50 μm displacement occurring in the target material under these conditions. The elastic wave generating from the displacement vibrates the crystals, causing dislocations and defects inside the crystals to migrate, and diffusing the solute elements. The extent of element migration is greater in the vicinity of the grain boundary than at the crystal grain center, and the atoms rearrange themselves to increase magnetization in the vicinity of the grain boundary under the applied magnetic field. This forms the iron-rich phase along the direction of the magnetic field in the vicinity of the grain boundary, and suppresses σ phase growth. The stress field increases as the magnetic field and the current amount increase.

The configuration of the apparatus shown in FIG. 1 is applicable to pipes used in, for example, a plant. The apparatus with the electromagnets 1 and 5, the electrodes 3, the heaters 6, and the displacement gauge 2 may be relocated to locally achieve heating with an elastic wave and a magnetic field in any location of a plant, and to find detect portions such as cracks by ultrasonic flaw detection performed with the apparatus. Defect portions can recover at low temperature by being subjected to the foregoing process.

Figure 2:
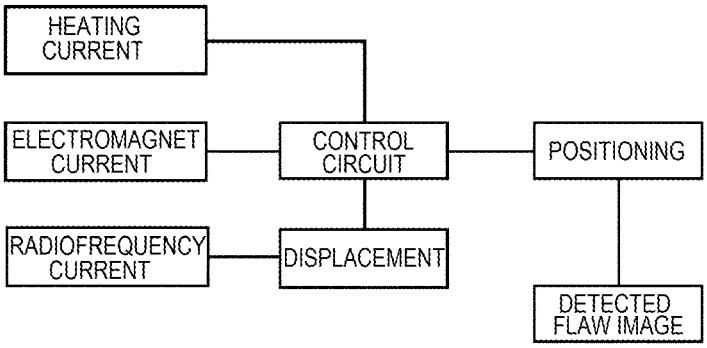
FIG. 2 is a schematic diagram representing a control system of an electromagnetic elastic wave process.

FIG. 2 is a schematic diagram representing a control system of the process. The system recognizes the location of a defect portion in an ultrasonically detected flaw image, and sets positions for the system devices. For the processing of the defect portion, a control circuit is used to control the heat current of the heaters, the passed current of the electromagnets, the radiofrequency current across contact terminals, and the displacement detected by the displacement gauge to optimize the temperature distribution, magnetic field distribution, and elastic wave distribution.

Figure 3:
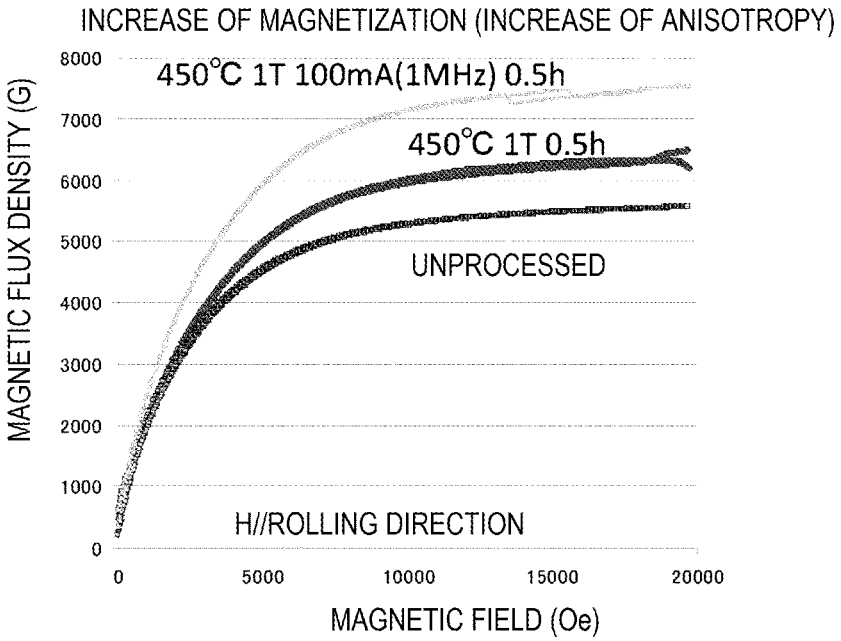
FIG. 3 represents a magnetization curve by an electromagnetic elastic wave process.

FIG. 3 represents a magnetization curve of the material subjected to the electromagnetic elastic wave process. The horizontal axis represents magnetic field (Oe), and the vertical axis represents magnetic flux density (G). The magnetic field is applied parallel to the rolling direction. It can be seen that adding the elastic wave to the material increases the magnetic flux density more than when the material is unprocessed or subjected to only the magnetic field. This is the result of the high magnetization iron-rich phase being formed in the vicinity of the grain boundary. It can also be seen that the saturation magnetic field occurs at the higher end of the magnetic field range after the electromagnetic elastic wave process. The result also shows an increase in the difference between the magnetization curves representing the magnetic field applied directions that are orthogonal to each other, specifically an increase of magnetic anisotropy.

Figure 4:
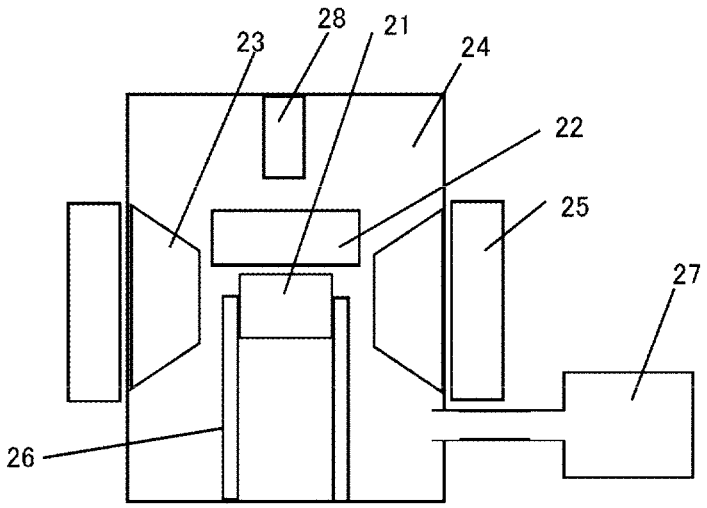
FIG. 4 is a diagram representing an electromagnetic elastic wave processing apparatus.

FIG. 4 represents an example of a processing apparatus for altering the structure of a material by using a magnetic field, an electric field, and a stress field in the manner described in the present embodiment. A heater 22 heats a target material 21 with the target material 21 in contact with an energization terminal 26. Upon passing current, an electromagnet 25 and a yoke 23 apply an external magnetic field to the target material 21, and the target material 21 is acted upon by an external stress under the passing current in the magnetic field. A displacement gauge 28 detects a displacement caused by the external stress, and the detected value is calibrated with the current frequency, the current amount, and the magnetic field strength. Inside of a chamber 24 can be evacuated with a vacuum pump 27, and diffusion can be promoted while forming a surface-hardened layer with a reactive gas such as a nitrogen gas and a hydrocarbon gas.

Second Embodiment

The present embodiment uses an iron plate containing 0.18 wt % C, 0.15 Si, 0.6 Mn, 1.0 Cr, and 0.15 Mo. The iron plate is rapidly cooled after nitrocarburizing the surface with a $NH_3$—CH mixed gas. The nitrocarburization temperature is 600° C. The nitrocarburization is followed by a heat treatment under applied electromagnetic field to remove residual strain, and diffuse nitrogen and carbon. The magnetic field is applied in 2 T. The plate is heated to 200° C. with an electromagnet, and maintained for 1 hour. A 1-kHz AC current is then passed at a current density of 0.1 A/mm$^2$. The electromagnetic field application has the following effects.

1) Nitrogen and carbon diffuse into a greater depth than when the electromagnetic field is not applied. Specifically, the electromagnetic field promotes nitrogen and carbon diffusion.

2) A high magnetization phase grows in the vicinity of the grain boundary of ferrite crystal grains.

3) Fine ferrite crystal grains are produced in the vicinity of the surface.

4) $Fe_4(N,C)$ partially decomposes to $Fe_4(N,C)_{1-x}$, where X=0.01 to 0.6.

5) The nitrogen and the nitrogen concentration in austenite (γ) increase by 0.02 to 0.1 wt % as compared to under no electromagnetic field.

6) The particle sizes of $Fe_4(N,C)$ and $Fe_4(N,C)_{1-x}$, where X=0.01 to 0.6, become smaller than when the electromagnetic field is not applied.

7) The c axis of $Fe_4(N,C)$ and $Fe_4(N,C)_{1-x}$, where X=0.01 to 0.6, becomes aligned parallel to the magnetic field direction as compared to under no electromagnetic field.

8) The electric field effect allows for controlling the concentrations of additive elements such as Mn, Cr, Mo, and Si, and diffusible elements such as carbon and nitrogen become more easily concentrated by the migration effect.

The electromagnetic elastic wave effect makes the iron plate material harder and stronger, with a hardness Hv of 800 and a tensile strength 1300 N/mm$^2$ in a region where laminar $Fe_4(N,C)$ can be seen. The increased hardness and tensile strength are more effectively achieved by the heat treatment under applied electromagnetic field than under no electromagnetic field, and the foregoing electromagnetic field application effect can be confirmed with an applied electromagnetic field of 0.01 T or more, a frequency of 60 to 1 MHz, and an AC current of 0.01 mA to 50 A/cm$^2$. The effect does not greatly improve even when the magnetic field is applied in 10 T or more. The optimum range of applied magnetic field is thus from 0.01 to 10 T.

The structure and composition control by electromagnetic field is applicable not only to Fe-based materials with a hardened layer as in the present embodiment but to Fe-, Ni-, and Co-based materials without a hardened layer, and can increase the tensile strength of these materials by 10 to 150% by way of controlling the concentration and the particle size of the additive elements.

Figure 5A:
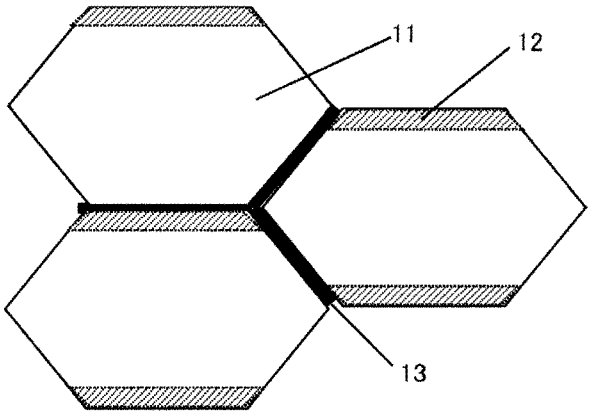
FIGS. 5A to 5C are diagrams representing structures after an electromagnetic elastic wave process.

The characteristics inside the material after the electromagnetic elastic wave process are described below with reference to FIGS. 5A to 5C. As shown in FIG. 5A, a high magnetization phase 12 grows substantially parallel to the direction of applied magnetic field, in addition to ferrite crystal grains 11 and a grain boundary 13. In the case of a rolled material, the horizontal direction in FIG. 5A represents the rolling direction, and the magnetic field is applied substantially parallel to the rolling direction. The crystal grains extend along the rolling direction, and a long grain boundary is formed along this direction. Because the magnetic field is applied along the rolling direction, the area where the high magnetization phase (iron-rich phase) is formed can be increased. The structure shown in FIG. 5A results when the magnetic field is applied in 0.01 to 1 T, and the current is passed in a current density of 0.01 to 0.1 mA/cm' at 300° C. or less. The current is passed substantially perpendicularly to the direction of the applied magnetic field.

Figure 5B:
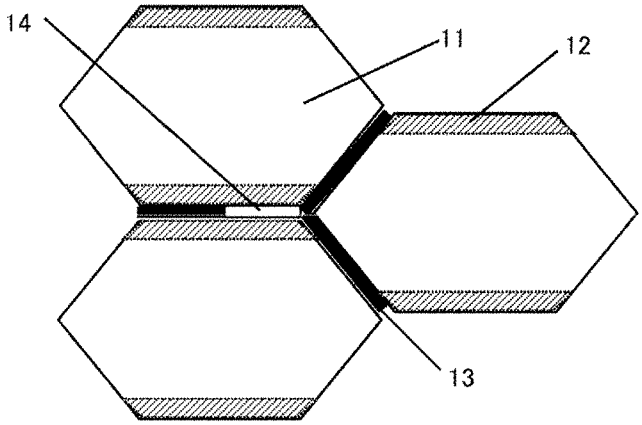

When the current is passed in a current density of 0.2 to 1 A/cm$^2$ under a 1 to 5 T magnetic field, a nitride, a carbide, an oxide, or a composite compound 14 of these tends to grow at the grain boundaries that are substantially parallel to the direction of the applied magnetic field, even at temperatures of 300° C. and less, as shown in FIG. 5B. This is the result of the solute elements (impurity elements in the alloy) partially diffusing under the effect of the elastic wave at and in the vicinity of the grain boundaries.

When the current is passed in an increased amount in a current density of 10 A/cm$^2$ under a 1 to 5 T magnetic field, the high magnetization phase forms along the outer periphery of the ferrite crystal grains 11 even at temperatures of 300° C. and less. As schematically illustrated in FIG. 5C, the high magnetization phase 12 and a high magnetization phase 15 can be seen on the outer periphery of the ferrite crystal grains 11. The high magnetization phase 12 is formed along the crystal grain boundary substantially parallel to the magnetic field direction, whereas the high magnetization phase 15 grows along the grain boundary with an angle from the magnetic field direction. A grain boundary phase 14 containing carbon, oxygen, or nitrogen is formed in parts of the grain boundary 13. A magnetization layer weaker than the average composition grows on the inner side of the high magnetization phases 12 and 15. The high magnetization phases 12 and 15 are 0.1 to 500 nm wide into the grains from the grain boundary.

Figure 5C:
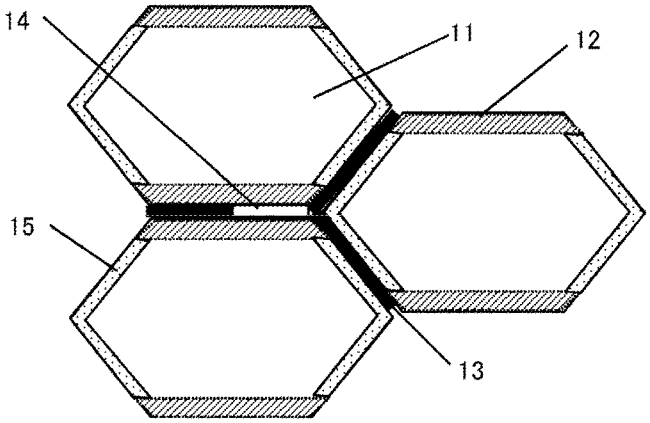

The structures with the characteristics represented in FIGS. 5A to 5C bring about the following property improvements. The tensile strength improves with the altered structure formed by altering the composition inside the crystal grains in a temperature range in which crystal grain growth is suppressed. The corrosion resistance improves as the impurities inside the grains form compounds along the grain boundary. Such strength increase and improved corrosion resistance can occur without having the high magnetization phase formed along the all grain boundaries, and formation of high magnetization phase in about 5% of the all grain boundaries contributes to improving the mechanical property and the corrosion resistance.

Third Embodiment

In the present embodiment, an Fe-1.0 wt % C steel plate and a 99.99% purity iron plate are compressed in layers to produce an Fe-1.0 wt % C/Fe diffusion couple. The diffusion couple is maintained for 2 hours in a 2 T magnetic field at 300° C., and rapidly cooled at a cooling rate of 50° C./min or more. An AC current is passed while applying the magnetic field. The current density is 0.1 mA/cm$^2$ to 2 A/cm$^2$, and the frequency is 50 to 10 GHz. The AC current is passed throughout the heat treatment in which the diffusion couple is maintained in a 2 T magnetic field at 300° C., or under a temperature that is at least 100° C. higher. This generates an eddy current, and creates the Lorentz force. The generated force acts on the crystals, and the synergy between the stress and the electromigration increases carbon diffusion 3 to 5 fold as compared to when the magnetic field or the current is not applied.

The magnetic field application, and the passing of AC current in the magnetic field as in the present embodiment creates an elastic wave that propagates through the material, and are highly effective for the control of the structure, the composition, the grain boundary structure, and the grain boundary concentration of not only Fe—C-based materials but other materials, including steel materials, iron-based amorphous materials, and metal glass. The diffusion promoting effect, and the grain boundary precipitation suppressing effect due to the stirring of the grain boundary composition and the grain boundary structure can be confirmed not only in Fe-based materials but in all materials with non-zero magnetic susceptibility.

The technique is applicable to a variety of materials, including high-strength and high-corrosion resistance structural materials, mold materials, anti-wear materials, heat-resistant materials, soft magnetic materials, hard magnetic materials, high saturated magnetization materials, thermoelectric conversion materials, magnetic freezing materials, shape memory materials, negative electrode and positive electrode materials of batteries, hydrogen storage materials, and magnetic shielding materials.

Fourth Embodiment

A 10 mm-thick steel material is subjected to a carburization process on the surface. The material used in the present embodiment is 0.02 C, 0.70 Si, 0.82 Mn, 12.9 Ni, 17.7 Cr, 2.1 Mo, and the reminder Fe (wt %)). The carburization uses a plasma from a DC plasma power supply, using a mixed gas of $CH_4$, $C_3H_8N_2$, $H_2$, and Ar. The carburization layer has a thickness of 0.5 mm after a 1000° C., 1-hour process.

After the carburization process, the sample is inserted into a magnetic field heat treatment furnace. The heat treatment furnace includes a coil for generating a magnetic field, a heater, an AC power supply for passing current through the heat-treated material, and a heat resistant terminal. The sample is heated to 400° C. under a 1.5 T magnetic field, and a 0.5 mA/cm$^2$ AC current is passed at 1 MHz. In the magnetic field heat treatment, the forced magnetostriction induced by magnetic field, and the AC-induced electromagnetic vibration widen the interatomic spacing, and the lattice vibration due to vibrational waves facilitates diffusion of the interstitial element carbon and nitrogen. The diffusion is further promoted particularly at the incoherent crystal grain boundary as the energy more easily accumulates therein because of the lattice vibration being affected by the orientation of the adjacent crystals. This is effective at reducing the post-carburization diffusion heat treatment time, and generating a metastable phase. The diffusion takes only half the diffusion time of a common simple heat treatment.

The forced magnetostriction and the AC-induced electromagnetic vibration in the present embodiment are similar to ultrasonic vibration in a magnetic field. The following effects are produced by the magnetic field ultrasonic waves or electromagnetic acoustic waves in a temperature region involving atom migration and diffusion.

1) The added ultrasonic energy that is controllable by ultrasonic frequency promotes diffusion.

2) The added friction by ultrasonic vibrations at the incoherent boundary easily creates localized energy accumulation, and promotes diffusion or creates concentrations of specific elements at the crystal grain boundary and the grain boundary triple point.

3) In materials that allow for passage of eddy current, the diffusion and concentration induced by electromagnetic acoustic waves or AC ultrasonic waves, and the generation of a metastable phase become more prominent in the vicinity of the surface, depending on the material shape, and the AC frequency.

4) The magnetostatic energy, the anisotropic energy, and the magnetoelastic energy become more contributory with the applied magnetic field of 1 T or more, and the ultrasonic vibration has effect on increase and decrease of these magnetic energies.

The ultrasonic vibration has different effective frequencies for different materials. With ultrasonic vibrations of two or more frequencies, it becomes easier to control the grain boundary composition, the grain boundary structure, and the composition in the vicinity of the grain boundary.

The magnetic field ultrasonic effect or the electromagnetic acoustic wave effect can be confirmed in different materials, as follows.

1) The diffusion of solute elements, and the concentrations of solute elements at the grain boundary can be promoted during carburization, nitridation, or nitrocarburization.

2) The growth of the grain boundary concentrated layer can be suppressed, and the precipitation nucleation sites can be ultrasonically eliminated in Fe—C-based steel materials.

3) A metastable phase with high magnetic susceptibility tends to grow in the vicinity of grains in Fe- and FeCo-based materials. The ultrasonic vibration and the magnetic field grow a layer of higher magnetic susceptibility at the grain boundary or in the vicinity of the grain boundary than in the grains, and reduce the magnetic energy.

4) A phase with a high Curie point tends to grow in the vicinity of the grain boundary in NdDyFeB-based materials, and Dy concentrates more in the vicinity of the grain boundary. This makes it possible to reduce the Dy amount in half.

The magnetic field ultrasonic effect or the electromagnetic acoustic wave effect also can be confirmed in applying a gradient magnetic field or an alternating magnetic field. Desirably, the gradient magnetic field is 0.1 T/cm or more, and the AC frequency is 1 kHz or more, particularly for the electromagnetic vibrational control of a composition distribution. With a heating temperature of 600° C. or more, some of the crystals undergo grain growth, and the mechanical property suffers. At higher heating temperatures, the reaction between the electrodes and the target material occurs more prominently, and the elastic wave propagation effect becomes notably smaller as the elastic modulus decreases. For these reasons, the effective elastic wave propagation temperature for structural alteration should be less than 600° C., desirably 500° C. or less.

The ultrasonic control of composition, components, and structure can be achieved by applying magnetic field and AC current to a heated material, and the effect can be localized by selecting the current frequency.

Fifth Embodiment

The present embodiment uses a steel plate containing 74.1 (wt %) Fe, 9.5 W, 5.0 Mo, 4.8 Co, 0.3 Mn, 4.3 Cr, and 2.0 V. About a 20 nm-thick CrN film is formed on a steel plate surface. A 1 T magnetic field is applied in the thickness direction of the material, and a 500-kHz AC current is passed in a direction perpendicular to the direction of the applied magnetic field while applying the magnetic field. The current density is 0.1 to 10 A/cm$^2$. The AC application to the steel plate in a magnetic field produces any of the following effects.

1) The added vibrational energy that is controllable by frequency promotes diffusion.

2) The added friction by vibrations at the incoherent boundary easily creates localized energy accumulation, and promotes diffusion or creates concentrations of specific elements at the crystal grain boundary and the grain boundary triple point.

3) Upon passage of eddy current, the diffusion and concentration induced by electromagnetic acoustic waves or AC ultrasonic waves, and the generation of a metastable phase become more prominent in the vicinity of the surface, depending on the material shape, and the AC frequency.

4) The magnetostatic energy, the anisotropic energy, and the magnetoelastic energy become more contributory with the applied magnetic field of 1 T or more, and the ultrasonic vibration has effect on increase and decrease of these magnetic energies.

These effects improve the adhesion of the CrN film, and create concentrations of additive elements at the grain boundary or in the vicinity of the grain boundary in the steel plate, with the result that the CrN film does not easily detach itself. Detachment is prevented because of the increased adhesion created by the diffusion of some of the constituting elements of the steel into the nitride film as a result of the interdiffusion occurring at the interface between the steel plate and the nitride film.

Instead of the current heating as in the present embodiment, heating may be performed by using, for example, a technique that pass AC current with a heater, or a technique that passes AC current under the heat of a laser or infrared rays. The AC current application can promote diffusion, and can cause changes in the interface structure, and compositional changes in the vicinity of the interface in a temperature range of 200 to 1200° C.

In order to prevent defects such as cracking through surface alteration of the nitride film, a technique that irradiates a plasma in a nitrogen atmosphere may be used. Surface defects on the nitride film can be reduced by passing AC current while irradiating a nitrogen plasma, or by passing AC current in a static magnetic field. This improves the insulation performance of the nitride film, and increases the wear life.

Sixth Embodiment

The present embodiment uses a steel plate containing 1.5 W, 5.0 Mo, 2.2 Co, 0.3 Mn, 24.3 Cr, 6.0 Ni, and the reminder Fe. With a CH-based gas, the carbon is diffused from the surface of the steel plate to form a surface-hardened layer. After heating the plate to 400° C., a 2.0 T magnetic field is applied in thickness direction, and a radiofrequency current is passed in a direction perpendicular to the direction of the applied magnetic field. The current frequency is 10 kHz to 100 MHz. The current density ranges from 0.1 mA/cm$^2$ to 100 A/cm$^2$.

The applied radiofrequency current causes the crystal lattice to vibrate under the applied magnetic field. Forced magnetostriction due to magnetic field is also present, enabling compositional or structural alteration in a current density and frequency dependent fashion. In the present embodiment, a carbide with high Cr, Co, or W concentration is formed in the surface-hardened layer by passing a 1 mA/cm$^2$ current at 100 kHz under a 2.0 T magnetic field at 700° C. This improves the hardness of the hardened layer, and prevents layer detachment.

The radiofrequency current application during the heat treatment under the magnetic field has the following effects.

1) The application facilitates diffusion of specific elements with the applied frequencies.

2) The developed electromagnetic acoustic wave forms a magnetically metastable phase.

3) A high magnetization metastable phase forms upon application of a high-frequency or harmonic wave current under a magnetic field of 1.5 to 20 T.

4) The composition distribution or magnetization distribution can be controlled by changing the direction of passing current or the direction of applied magnetic field.

5) A material containing different diffusing elements and different structures inside and at the surface of the material is obtained with different combinations of currents and magnetic fields, such as a combination of a harmonic wave current and a high-frequency magnetic field, and a combination of a harmonic wave current and a low-frequency magnetic field.

The composition, the structure, and the components of the solid phase can be controlled with any of these effects, and the radiofrequency current contributes to atom migration in the solid phase.

The process by which radiofrequency current is applied to the heat-treated solid phase under a magnetic field as in the present embodiment produces strong forced magnetostriction and lattice vibration effects, and contributes to controlling the diffusion, the grain boundary structure, and the interface structure, and creating concentrations of specific elements. The process thus has many different applications other than structural materials, including, for example, soft magnetic materials, hard magnetic materials including nanocomposites, superconductive materials, magnetostrictive materials, magnetic freezing materials, thermoelectric conversion materials, magnetic recording material, magnetism shielding materials, refractory metals, and various composite materials.

The method that applies magnetic field and AC current in a temperature range in which solid phase diffusion of atoms occurs as in the present embodiment enables compositional, structural, and componential control in any shape and direction when adapted to three-dimensionally apply a magnetic field or an AC current. The method is thus applicable to products that cannot be produced by common methods that can deal with only simple shapes.

Seventh Embodiment

The present embodiment uses an iron plate of 99.99% purity. Iron carbide is grown in the iron plate surface, and the percentage volume of the iron carbide becomes smaller from surface into the depth of the plate. The iron carbide is predominantly $Fe_3C$, as can be recognized through X-ray diffraction pattern measurement. Metal electrodes are attached to the iron plate surface, and current is passed while externally applying a 1 T magnetic field. The current is AC current with a frequency of 1 MHz and a current density of 1 A/mm$^2$. The angle between the direction of applied current and the direction of applied magnetic field is about 90 degrees. The heating temperature is 200° C., and the current is passed for 1 hour.

The energization passes AC current between the electrodes, and there is a displacement in current distribution, with the current passing in greater amounts on the electrode contacting surface than on the opposite surface. The current distribution is vertically or laterally asymmetrical about the plane perpendicular to the direction of applied current. With such a current distribution, the Lorentz force more strongly acts on the surface with the higher current density, and the elastic wave develops on this surface. The elastic wave propagates in thickness direction, and causes elastic deformation (lattice deformation) in the iron plate. The vibrational energy increases as the frequency increases, and the diffusion of interstitial elements such as carbon accelerates under the effects of the elastic wave and the magnetic field. Under these conditions, the diffusion distance increases 2 to 5 fold compared to when there is no current or magnetic field application, as can be confirmed from the result of carbon analysis, the hardness distribution, and the carbide distribution.

At 1 MHz frequency, the diffusion promoting effect can be obtained with an external magnetic field of 0.1 to 20 T, and a current density of 0.01 to 10 $A/mm^2$ under the foregoing conditions. With the external magnetic field of 1 T, and the current density of 1 $A/mm^2$, the diffusion distance can increase 1.5 to 5 fold when the AC frequency range is between 1 kHz and 100 GHz. The diffusion involves a resonance phenomenon at specific frequencies, and carbides, such as the metastable phase $Fe_4C$ and $Fe_3C$, having higher saturated magnetization than $Fe_3C$ form at specific frequencies. The elastic wave can propagate in different directions, and the diffusion can accelerate in a localized fashion when the number of electrodes is increased to pass AC currents of different frequencies.

What is claimed is:

1. A material processing method comprising:

heating a steel material that contains a plurality of ferrite crystal grains;

applying a magnetic field to a heated portion while heating the steel material;

applying an electric field to the heated portion in a direction that crosses the direction of the applied magnetic field while heating the steel material; and measuring a displacement occurring in the steel material under the magnetic field and the electric field;

wherein the magnetic field is applied from 0.1 to 10 T with a magnetic field applying device, and wherein an energizing device passes a current in a current density of 0.01 to 1 $A/mm^2$ and at a frequency of 1 to 10 GHz.

* * * * *